United States Patent [19]

Winterer

[11] Patent Number: 4,465,126

[45] Date of Patent: Aug. 14, 1984

[54] HEAT EXCHANGER ARRANGEMENT, ESPECIALLY FOR RADIATORS FOR MOTOR VEHICLES

[75] Inventor: Wilfried Winterer, Leinfelden-Echterdingen, Fed. Rep. of Germany

[73] Assignee: Süddeutsche Kühlerfabrik Julius Fr. Behr GmbH & Co. KG, Stuttgart, Fed. Rep. of Germany

[21] Appl. No.: 486,805

[22] Filed: Apr. 20, 1983

[30] Foreign Application Priority Data

Apr. 20, 1982 [DE] Fed. Rep. of Germany ..... 3214453

[51] Int. Cl.[3] ..... F28F 7/00

[52] U.S. Cl. ..... 165/77; 165/149; 165/151; 165/134 R

[58] Field of Search ..... 165/149, 151, 76, 69, 165/134 R, 77; 29/157.3 B

[56] References Cited

U.S. PATENT DOCUMENTS 1,507,964 9/1924 Hudson ..... 165/77

FOREIGN PATENT DOCUMENTS 2090958 7/1982 United Kingdom ..... 165/151

*Primary Examiner*—Sheldon J. Richter

*Assistant Examiner*—John F. McNally

*Attorney, Agent, or Firm*—Barnes & Thornburg

[57] ABSTRACT

A radiator for motor vehicles is provided which has several tubes opening to respective upper and lower radiator tanks and arranged parallel to one another for the guidance of heat exchange fluid. Heat exchange fins are disposed perpendicularly to the tubes and are fixedly connected thereto. The fins exhibit respective cut-out openings forming a groove at at least one of the surfaces of the fin blocks, which groove expands toward the inside and serves for connecting lateral parts, which lateral parts grip with tabs into the groove formed by the cut-outs. Each lateral part is formed of two halves which are pivotally connected with one another along an axis running in the direction of the groove and which are provided with tabs which extend outwardly over the lateral edges of the halves into the groove and abut the fins on the lateral walls of the groove. To form a rigid or stiff connection between the lateral part halves after their installation in the groove, locking or closing elements are provided. Both lateral part halves can be pivoted with respect to one another for installation into the groove so that a very small opening width of the cut-out is sufficient to accommodate the installation of the lateral parts, especially advantageous for thin radiators.

20 Claims, 11 Drawing Figures

HEAT EXCHANGER ARRANGEMENT, ESPECIALLY FOR RADIATORS FOR MOTOR VEHICLES

BACKGROUND AND SUMMARY OF THE INVENTION

The invention relates to heat exchangers, especially radiators for motor vehicles, with pipes or tubes opening into upper and lower water boxes for the guidance of heat exchange fluid, which pipes are arranged parallel to one another, and with heat exchanger fins extending perpendicularly to the pipes and fixedly connected thereto. The fins on at least one of the surfaces exhibit cut-outs which are expanded toward the inside to form a groove and serve for the attachment of lateral parts, which lateral parts grip with tabs into the groove formed by the cut-outs.

Heat exchangers wherein the lateral parts are not connected at the water boxes, but rather at the heat exchange fins themselves, are known, for example, from German published application DE-OS 24 18 132. The lateral parts are there formed respectively in one part and connected at the fins by stamped-out tabs which are bent more than 90° out of the plane of the lateral part by a bending work tool so that the tabs abut against angularly extending inner walls of a groove formed at the fins. Because with this kind of attachment of the lateral parts a bending work tool is necessary, the opening width of the cut-outs in the fins and the correspondingly formed groove must be large enough to accommodate the insertion and utilization of the bending tool. See also U.S. Pat. No. 3,795,274 showing arrangements for clamping the radiator fins utilizing grooves formed at the lateral outside surfaces of the fins. These requirements, especially with heat exchangers having a small construction depth, can not always be fulfilled, so that an attachment in this manner is then not possible. The invention is based upon the problem to create a heat exchanger wherein the lateral parts can be simply attached directly at the fins, even in radiator fin blocks having a small construction depth or thickness.

This problem is solved according to the invention by providing that each lateral part is formed of two halves which are provided respectively with side edges which are pivotally connected with one another along an axis extending in the direction of the groove in the fins and which halves are both provided with tabs which extend outwardly from the respective side edges into the groove to abut against the lateral groove walls. In order to create a rigid and stiff connection between the lateral halves after their installation in the groove, closing elements are provided.

With the arrangement of the invention it is possible to connect the two halves of the lateral parts together without a bending work tool. Because the lateral halves are pivotable about an axis extending in the direction of the groove they can be first so disposed with respect to one another that they form a sharp angle with respect to one another with the tabs of both lateral parts extending in somewhat the same direction and in almost the same plane. They then exhibit only a small spacing from one another (as seen in the direction along the pivot axis) so that they can easily be installed into a small opening of the inwardly expanding groove at the fins. Thereafter, the lateral halves are pivoted with respect to one another so that the angle between them and also between the tabs is enlarged. In this way, the tabs of the halves abut respectively onto the oppositely disposed inwardly diverging walls of the groove formed in the fins. Therefore, no bending work tool is necessary to install the lateral halves so that the cut-outs in the fins forming the connecting groove can be formed relatively small. Especially with heat exchanger or radiator blocks having a narrow or small construction thickness, this is an advantage. It is also advantageous that the lateral parts can be installed at the heat exchanger at a later stage of manufacture. After the insertion of the tabs and the pivoting of the lateral part halves with respect to one another, the lateral part halves are rigidly connected to one another by closing elements so that the strength connection at the fin block is fixed and cannot come loose by itself.

It is advantageous if the tabs are set-off with respect to one another like the teeth of a comb to form a certain separation or division with respect to one another, with the tabs of the respective other identically formed but sideways disposed lateral part half being interlacingly gripped with their respective tabs. Because of the identical formation of the lateral part halves, it is possible to manufacture the same of indefinite length according to especially preferred embodiments. It is then unnecessary to be concerned with the sidewise disposition of the two halves during their formation. Furthermore, the manufacture of such lateral part halves is then very simple.

According to a further construction feature of the invention, the cut-outs are widened in a dove-tailed shape and the tabs are formed as straight tabs which are disposed at an angle with respect to the associated lateral part half, which angle is greater than 90°. This configuration of the tabs is especially simple to manufacture and assemble.

It is also advantageous according to preferred embodiments of the invention to provide that the tabs are formed with a hook-shape and are provided with respective slots which are disposed immediately adjacent the lateral edges of the halves and extend in the axial direction and exhibit a width which is at least the thickness of the lateral part halves. The lateral part halves are then connected with one another before they are installed into the groove and are installed as a single unit. The actual pivot axes of the lateral part halves with respect to one another are thereby formed by and at said slots. To secure against the sliding of the fastened lateral part halves in the direction of the groove (axial direction of the groove formed by the cut-outs in the fins) it is furthermore advantageous if the tabs are provided with teeth which engage into the heat exchanger fins.

For lateral part halves which are made of sheet metal, it is advantageous according to a feature of the invention to fix a sheet metal plate to the lateral part halves as the closing or locking element. This sheet metal plate preferably extends laterally over both lateral halves and is welded together with the halves at their upper sides.

According to other preferred embodiments, the lateral parts are manufactured out of injection molded plastic parts whereby they can be formed together as a single part if they are connected to one another with a film hinge along the pivot axis. It is then also contemplated to use a holder as a closing element, which holder sits with a floor plate on the lateral parts and exhibits openings in the floor plate that accommodate a hooking or latching connection by means of nubs extending into the holes. In this manner, on the one hand, the lateral part halves are reliably fastened to the holder and on the other hand, they are simultaneously serving for the closing connection of the lateral part halves. It is also contemplated to provide embodiments wherein, instead of a special separate holder, a holder is formed together as a single part with the lateral part halves from the walls thereof so that no additional holder is necessary.

According to a further advantageous feature of certain preferred embodiments of the inVention, it is provided that the lateral part halves are provided with wall sections bent 90° from the front surface of the heat exchanger fins and abutting sideways on the lateral outer edges of the heat exchanger fins so that the lateral parts effectively grip the heat exchanger fins between these wall sections. In these arrangements, the position of the lateral parts at side surfaces of the fins is fixed very reliably and a possible shoving of the lateral part halves in the direction of the groove is avoided. It is then also possible to use as a closing element, a pin, stuck through holes through the wall cut-outs, and which pins extend beyond the wall cut-outs, and are there bent upward on their ends.

Further objects, features, and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
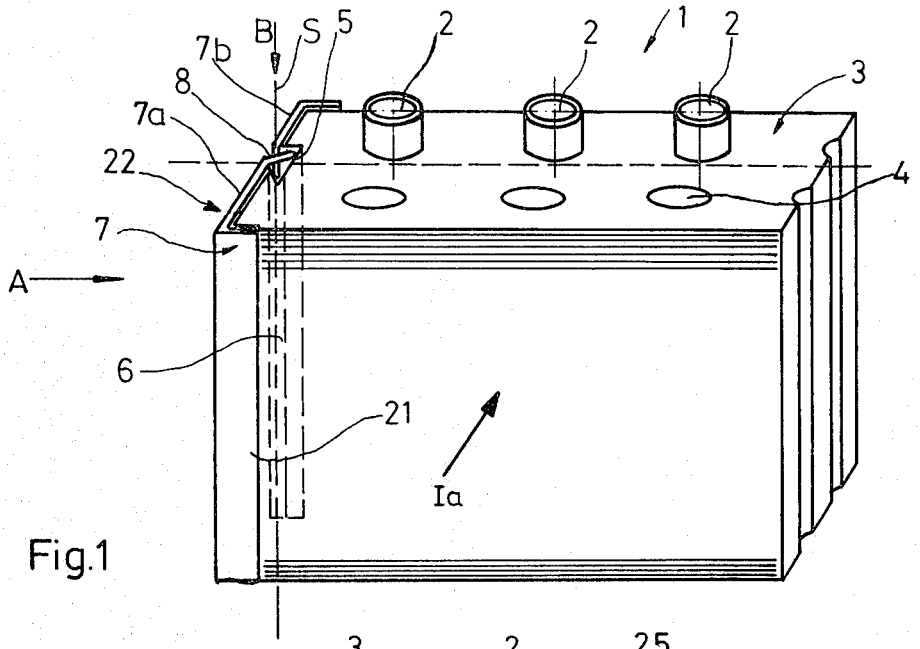
FIG. 1 is a perspective view of a section of a radiator constructed in accordance with a preferred embodiment of the invention, shown without the radiator tanks.

FIG. 1 is a perspective view of a section of a heat exchanger of a cooler, or radiator, which includes a fin block 1 formed of pipes 2 and cooling fins 3. The pipes or tubes 2 are supplied with heat exchange medium, for example, water that streams therethrough, and the cooling fins 3 are supplied with flowing fluid of another heat exchange medium, for example, air. The radiator tanks 25 and 26 at the respective upper and lower ends of the tubes 2 are illustrated in FIG. l*a.* The cooling fins 3 are arranged parallel to one another with a small spacing therebetween and extend substantially perpendicularly to the longitudinal axes of the tubes 2. The cooling fins 3 are fixedly connected with the tubes 2.

Figure 1A:
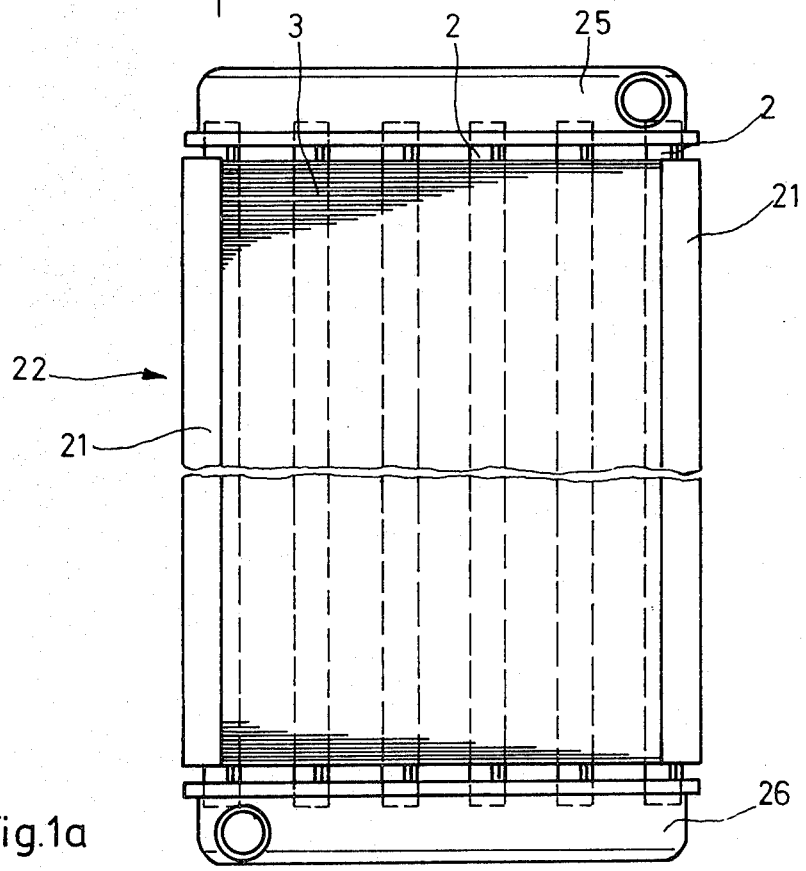
FIG. 1*a* is a side view taken in the direction of arrow 1*a* of the FIG. 1 illustrated radiator, shown with the radiator tanks.

The fins 3 exhibit openings for the tubes 2 and include dove-tailed formed cut-outs 5 which form a through extending groove 6 in the fin block 1 at the end surface side 22. Only one end surface side 22 is shown in FIG. 1, the other end surface side including a similar configuration (compare FIG. 1*a*). The groove 6 serves for the attachment of the side or lateral parts 7 to a holder (not illustrated in FIG. 1) for the attachment of the heat exchanger or radiator, for example, for the attachment thereof in a motor vehicle. The lateral parts consist of two halves 7*a* and 7*b,* which grip with tabs 8 in the groove 6 formed by the cut-outs 5. Each lateral part half 7*a,* 7*b* extends respectively over half of the wall surface 22 and is actually held by means of the gripping of the tabs 8 in the groove 6. Furthermore, the lateral parts 7 (halves 7*a,* 7*b*) exhibit respective wall sections 21 bent approximately 90° from the front surface 22 of the heat exchanges fins 3 which abut sideways at the fins 3.

As can be seen from the other drawing figures, the tabs 8, 8*a* extend outwardly into the groove 6 at an angle $\alpha$ with respect to the lateral edges 20, which angle $\alpha$ is greater than 90°. The tabs 8, 8*a* abut in the direction of the groove 6 alternatingly at the side walls 5*a,* 5*b* of the dove-tailed form cut-outs 5 (compare FIG. 2*b*). The lateral part halves 7*a* and 7*b* are pivotal about the axis "S" so that they can be placed in a position in which the tabs grip into one another (are folded toward the same plane) for installation in groove 6 and are so pivoted that the distance between the free ends of the tabs is smaller than the small front side opening of the groove 6. After the installation of the tabs in the groove, the halves 7*a* and 7*b* are pivoted to separate the tabs so that the tabs of one half abut at one wall 5*a* and the tabs of the other half abut the other wall 5*b* in such a manner that the respective tabs of one of the lateral halves abuts against the oppositely disposed wall. There is thereby no bending work tools that must be guided into the groove necessary for the attachment of the lateral parts. The cut-outs 5 can thereby be made relatively small.

Figure 2A:
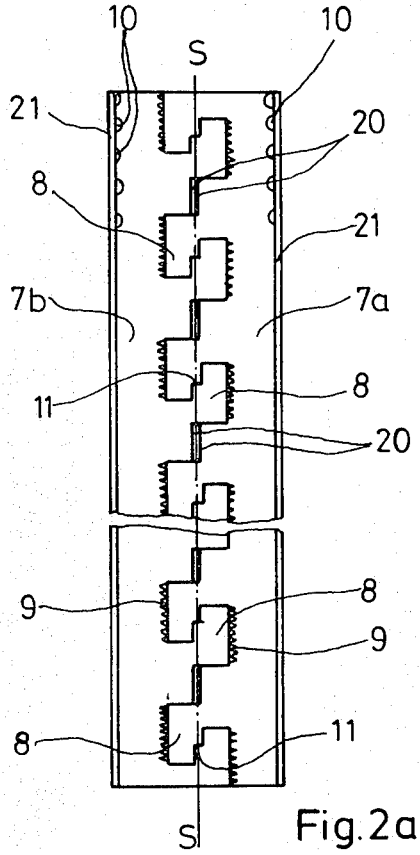
FIG. 2*a* is a side view taken in the direction of arrow A of FIG. 1 and showing two lateral part halves connected with one another.
Figure 2C:
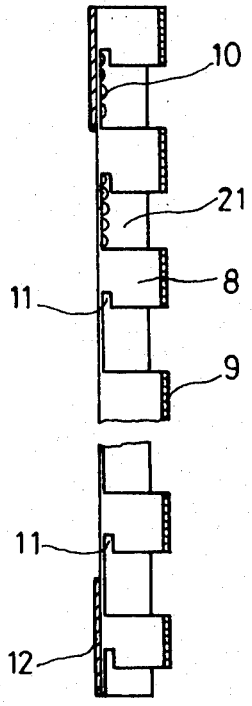
FIG. 2*c* is a side sectional view along the pivot axis of the lateral part halves shown in FIG. 2*a* and FIG. 2*b;*
Figure 2B:
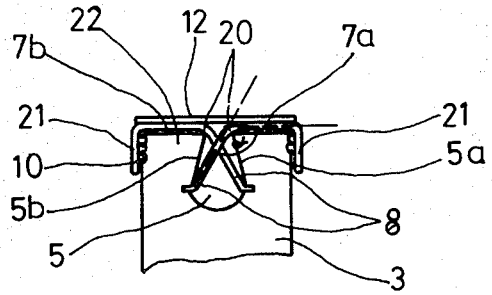
FIG. 2*b* is a partial view taken in the direction of arrow B of FIG. 1 and showing the lateral part halves of FIG. 2*a;*

In the illustrated embodiment of FIGS. 2*a* to 2*c,* the lateral part halves 7*a,* 7*b* are formed out of sheet metal and are identically constructed. They can therefore be manufactured in a continuous length. The tabs 8 are hooked-formed and respectively provided with a slot 11 which immediately borders the lateral edges 20 and extends in the direction and has a width which is somewhat larger than the thickness of the lateral part halves 7*a,* 7*b.* The pivot axis "S" extends along the slots 11. At the free end of the tabs 8 are teeth 9 which grip into the heat exchanger fins 3 so that a longitudinal shoving of the lateral parts in the groove is impossible.

By means of the slots 11, the lateral parts can be hanged or hooked into one another and thereby pivotally connected with one another to accommodate the above-described installation. After the installation in the above-described manner, the possibility that the lateral part halves can be loosened by pivoting with respect to one another is prevented by providing that a sheet metal holder 12 (FIG. 2*b*) is applied across over the upper surfaces of the lateral part halves 7*a*and 7*b* and is welded thereto so that the lateral parts are fixedly anchored in the groove. Further, on the wall sections 21 of the lateral part halves, there are provided teeth 10 which protrude respectively between the heat exchanger fins 3 so that thereby the reliability of the connection is increased.

Figure 3A:
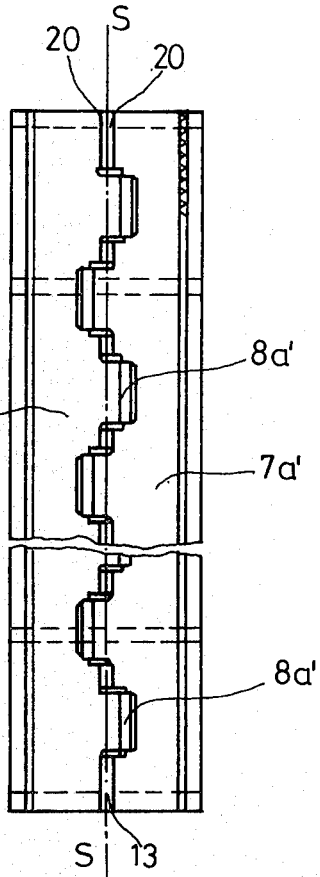
FIG. 3*a* is a view taken in the direction of arrow A of FIG. 1 and showing two lateral part halves connected with one another according to a further preferred embodiment of the invention.
Figure 3C:
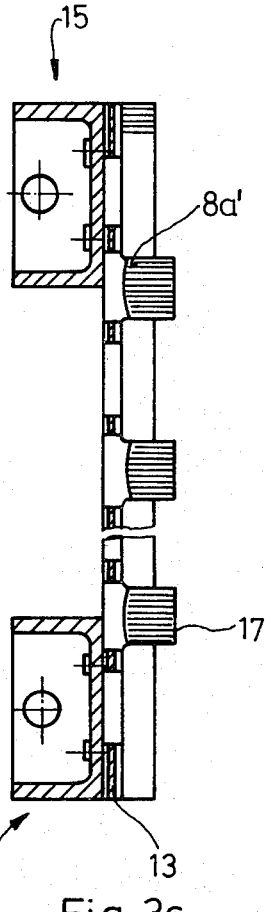
FIG. 3*c* is a side sectional view along the pivot axis of the lateral part halves shown in FIGS. 3*a* and 3*b;*
Figure 3B:
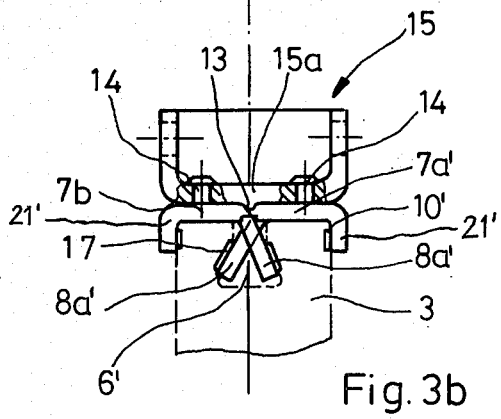
FIG. 3*b* is a view taken in the direction of arrow B in FIG. 1 and showing the lateral part halves of FIG. 3*a;*

The lateral parts illustrated in FIGS. 3*a*, 3*b* and 3*c*, are manufactured out of plastic. The two halves 7*a'*, 7*b'* are connected with one another at the pivot axis by a formed film hinge 13 so that the tabs 8*a'* formed therewith can be installed in the groove 6' formed by the cut-outs by a corresponding pivoting, without further tools or steps being required. The tabs 8*a'* are of rectangular shape and grip respectively like teeth into one another. At the upper surface of the lateral part halves 7*a'*, 7*b'* there are nubs 14 formed for accommodating a holder 15 by means of its floor plate 15*a* and openings therein for latching onto the nubs.

With this arrangement, on the one hand, a very simple assembly of the holder is possible and on the other hand the holder can also serve as a closing element to prevent the pivotal movement of the two parts 7*a'*, 7*b'* after they are fastened into the groove 6'. The tabs 8*a'*, 8*b'* are provided on their outersides with teeth 17 which grip between the heat exchanger fins in order to prevent a sliding or shoving of the lateral parts. Teeth 10' at the wall section 21' also engage the fins to prevent axial sliding of the lateral parts.

Figure 4A:
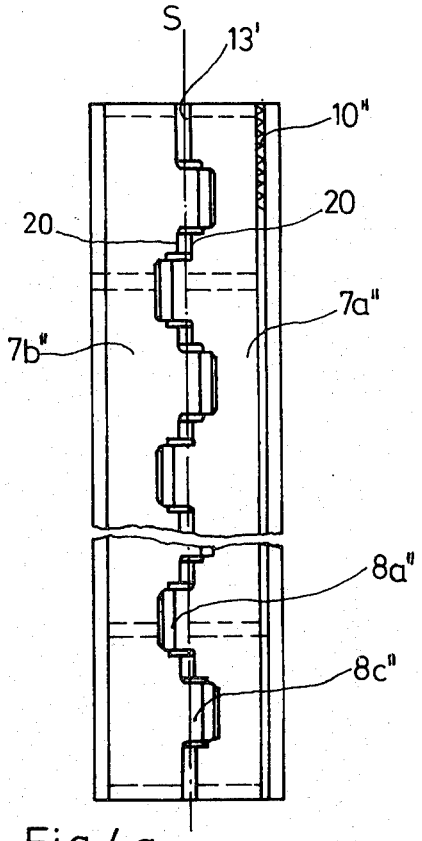
FIG. 4*a* is a view taken in the direction of arrow A of FIG. 1 showing two lateral part halves connected with one another according to a further preferred embodiment of the invention.
Figure 4C:
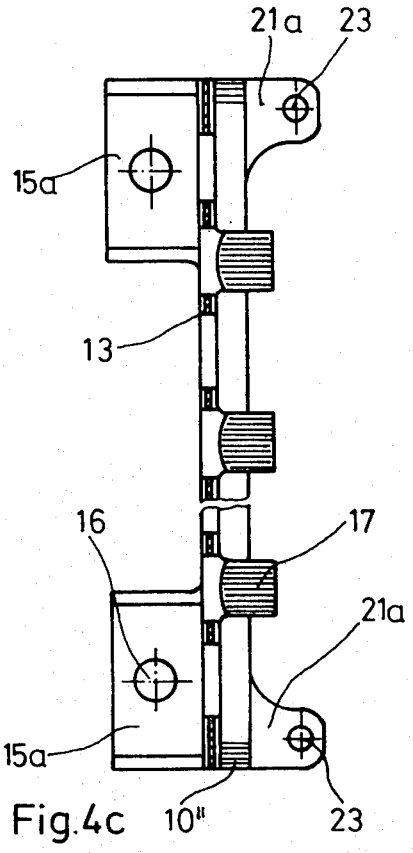
FIG. 4*c* is a side sectional view along the pivot axis of the lateral part halves shown in FIGS. 4*a* and 4*b.*
Figure 4B:
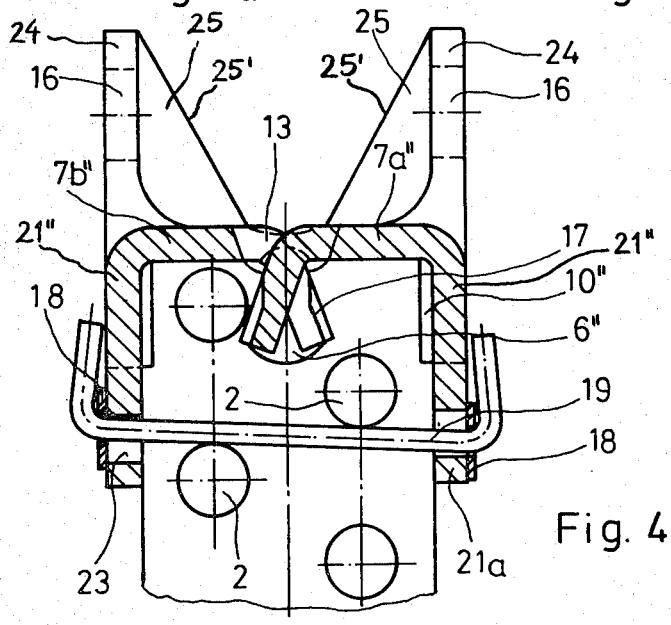
FIG. 4*b* is a view taken in the direction of arrow B of FIG. 1 and showing the lateral part halves of FIG. 4*a,* but in an enlarged version.

Also the FIGS. 4*a* to 4*c* illustrated embodiment includes lateral parts which are manufactured out of plastic. Also in this embodiment, a film hinge 13' connects the two lateral parts 7*a''* and 7*b''*. The shape of the tabs 8*a''* is also rectangular. Differentiating from the FIG. 3 to FIG. 3*c* illustrated embodiment, the lateral parts of the FIG. 4 embodiment are connected to one another by an anchoring pin or pins 19. With this arrangement, the wall sections 21' are extended bracket-like (21*a*) at appropriate locations, expecially at the beginning and the end (as seen in the longital direction of the lateral parts) and are there provided with bores 23 (compare FIG. 4*c*) through which the pins 19 can be inserted. The pins 19 are respectively longer than the distance between the oppositely disposed wall sections 21' so that the ends extend or overlap beyond the wall sections. The pins can thereby be so bent when they are shoved between two adjacent heat exchanger fins, in any event under disposition of a separating washer 18, that therewith the lateral parts are closed or locked together. This kind of closing can naturally also be provided for correspondingly constructed sheet metal lateral parts according to further preferred embodiments.

With a missaligned disposition of the tubes 2 with respect to one another (compare FIG. 4*b*) the pins 19 can extend between the heat exchanger fins in a non parallel manner as shown in FIG. 4*b*. The diameter of the bores 23 is somewhat greater than the diameter of the pins 19 in order to facilitate the simple insertion of the pins 19. Because the distance between adjacent heat exchanger fins is normally smaller than a pin diameter, the heat exchanger fins between which the pin is shoved are bent slightly outwardly, a factor which really has no negative influence on the function of the heat exchanger. Teeth 10'' at the wall sections 21'' engage between the fins to further secure the parts against movement in the axial direction.

Furthermore, single piece arrangements are provided with upper spaced walls 24, 25 formed at the lateral part halves (FIG. 4*b*). Oppositely disposed bores 16 are provided in the walls 24 forming a groove, by means of which a connection of the heat exchanger or radiator to a vehicle body or frame is facilitated. The wall sides 25 which extend perpendicular to the direction of the groove 6 slope (see edge 25' in FIG. 4*b*) in the direction toward groove 6 to accommodate pivotal movement of the parts for installation of the tabs 8*a''*, 8*b''* in the groove 6''.

While we have shown and described several embodiments in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

I claim:

1. Heat exchanger arrangement for motorized vehicle radiators and the like comprising:

first and second radiator tanks, a plurality of heat exchange tube means extending between and opening into said radiator tanks for accommodating flow of a heat exchange fluid therethrough, a plurality of heat exchange fin means extending transverse to and fixedly connected with said tube means, said fin means including respective aligned cutouts along at least one side thereof, said cut-outs forming a connecting groove, and lateral part means engageable with said fin means at said connecting groove for holding said assembly of tube means and fin means in position in a motor vehicle or the like, wherein said lateral part means are formed of respective halves which are pivotably connected together to pivot about an axis extending along the connecting groove, each of said halves including tab means which extend outwardly away from the axis.

2. An arrangement according to claim 1, further comprising closing element means for locking said lateral part halves into their fin groove engaging positions.

3. An arrangement according to claim 2, wherein the tab means of the respective halves are configured in the manner of comb teeth, off-set with respect to the corresponding tab means on the other half, said tab means being interlacingly disposed during installation of the lateral part means into the connecting groove.

4. An arrangement according to claim 3, wherein the lateral part means are constructed as two separate part halves, said halves being identical to one another, but off-set in the longitudinal direction of the groove in an assembled position.

5. An arrangement according to claim 1, wherein said cut-outs expand in the inward direction in a dove-tailed configuration, and wherein the tab means are formed as straight tabs which extend at an angle of more than 90° from the plane of the wall of the respective half engaging the surface of the fins immediately adjacent the groove.

6. An arrangement according to claim 3, wherein said cut-outs expand in the inward direction in a dove-tailed configuration, and wherein the tab means are formed as straight tabs which extend at an angle of more than 90° from the plane of the wall of the respective half engaging the surface of the fins immediately adjacent the groove.

7. An arrangement according to claim 1, wherein the tab means include hooked-shaped tabs provided respectively with a slot extending immediately adjacent the lateral edges of the respective halves in the axial direction of the groove, said slot exhibiting a width which is at least the thickness of the sheet material forming the halves.

8. An arrangement according to claim 4, wherein the tab means include hooked-shaped tabs provided respectively with a slot extending immediately adjacent the lateral edges of the respective halves in the axial direction of the groove, said slot exhibiting a width which is at least the thickness of the sheet material forming the halves.

9. An arrangement according to claim 1, wherein the tab means are provided with teeth which grip into the heat exchanger fins.

10. An arrangement according to claim 4, wherein the tab means are provided with teeth which grip into the heat exchanger fins.

11. An arrangement according to claim 2, wherein the lateral part halves are manufactured out of sheet metal.

12. An arrangement according to claim 11, wherein the closing element is provided in the form of a sheet metal plate fixedly connected to the lateral halves.

13. An arrangement according to claim 2, wherein the lateral halves are made of injection molded plastic parts.

14. An arrangement according to claim 8, wherein the lateral halves are connected with one another by means of a film joint or hinge at the pivot axis "S".

15. An arrangement according to claim 13, wherein a holder is provided as the closing element means, which holder sits with a floor plate thereof on the lateral halves, said floor plate exhibiting openings for accommodating insertion of nubs for a latching connection to the halves.

16. An arrangement according to claim 14, wherein a holder is provided as the closing element means, which holder sits with a floor plate thereof on the lateral halves, said floor plate exhibiting openings for accommodating insertion of nubs for a latching connection to the halves.

17. An arrangement according to claim 13, wherein spaced walls are provided as holders in one piece with the lateral halves, said spaced walls extending substantially perpendicular to the upper surface of these lateral halves.

18. An arrangement according to claim 2, wherein the lateral halves are bent 90° with respect to the front side of the fins containing the groove cut-outs and are provided at the sides with wall sections abuttingly engagable at the heat exchange fins.

19. An arrangement according to claim 18, wherein the closing element means includes a pin extending between the wall sections and through respective bores, which pin extends laterally beyond the wall sections and the protruding pin ends are bent back upon the wall sections.

20. An arrangement according to claim 19, wherein spaced walls are provided as holders in one piece with the lateral halves, said spaced walls extending substantially perpendicular to the upper surface of these lateral halves.

* * * * *